United States Patent [19]

Schleich

[11] 3,946,348

[45] Mar. 23, 1976

[54] RADIATION RESISTANT DUCTED SUPERCONDUCTIVE COIL

[75] Inventor: Armin Schleich, Zurich, Switzerland

[73] Assignee: BBC Aktiengesellschaft Brown, Boveri & Cie., Baden, Switzerland

[22] Filed: May 1, 1974

[21] Appl. No.: 466,073

Related U.S. Application Data

[62] Division of Ser. No. 234,728, March 15, 1972.

[30] Foreign Application Priority Data

Mar. 22, 1971 Switzerland ..... 4177/71

[52] U.S. Cl. ..... 335/216; 174/126 S

[51] Int. Cl.[2] ..... H01F 7/22

[58] Field of Search ..... 335/216; 174/DIG. 6

[56] References Cited

UNITED STATES PATENTS

| | | | |
|---|---|---|---|
| 3,408,235 | 10/1968 | Berghout et al. | 335/216 X |
| 3,540,114 | 11/1970 | Roberts et al. | 29/599 X |
| 3,614,301 | 10/1971 | Royet | 335/216 X |
| 3,800,061 | 3/1974 | Larson et al. | 174/DIG. 6 |

*Primary Examiner*—G. Harris

*Attorney, Agent, or Firm*—Pierce, Scheffler & Parker

[57] ABSTRACT

A radiation resistant ducted superconductive coil consists of a helically wound electrical conductor constituted by an electrically conductive core of superconductive material provided with a longitudinally extending cooling duct, the core being covered with a layer of inorganic insulating material and the latter being covered by an electrically conductive metallic gas-tight sheath. The metallic sheaths on adjacent turns of the coil are secured together.

2 Claims, 4 Drawing Figures

RADIATION RESISTANT DUCTED SUPERCONDUCTIVE COIL

This is a division of Ser. No. 234,728 filed Mar. 15, 1972.

The present invention relates to an improved construction for a helically wound radiation resistant ducted superconductive coil which includes an insulation layer of inorganic material.

In order to comply with the specifications hitherto demanded by nuclear research institutes, wound insulations just capable of withstanding a radiation dose of $10^{10}$ rad have been developed. These insulations are built up from glass-fibre fabrics and mica and permeated with hardenable synthetic resins, the winding also being held together in this way.

However, hitherto known organic materials are destroyed at a radiation dose of more than $10^{10}$ to $10^{11}$ rad.

It has therefore already been proposed to use an insulation made of purely inorganic material, a coil cast in concrete being used. Concrete insulation will withstand more than $10^{15}$ rad, but it must be everywhere held under mechanical compression stresses in order to prevent the occurrence of cracks. This requires special design of the magnetic coil structures and tests on the behaviour of prototypes. Such concrete insulations therefore require relatively complicated construction, and are unsuitable for production in small numbers or singly.

The object of the invention is to provide an insulated superconductive coil whereof the insulation does not exhibit the above-mentioned disadvantages and is simple to produce.

It is expedient for the conductor made of ducted superconductive material wound with at least one insulating tape to be wrapped with a metal tape which can either be made from the solid metal itself or from stranded material which is woven, or plaited, or otherwise fashioned into fabric form.

It is advantageous for the metal sheath to be soldered or welded into a unit which firmly encases the insulation of the conductor.

It is furthermore expedient to use an insulating tape consisting at least partly of metal oxide such as aluminum oxide and/or glass fibre and/or asbestos and/or mica.

The invention is explained hereinafter by way of example and with reference to the accompanying drawings wherein.

Figure 1:
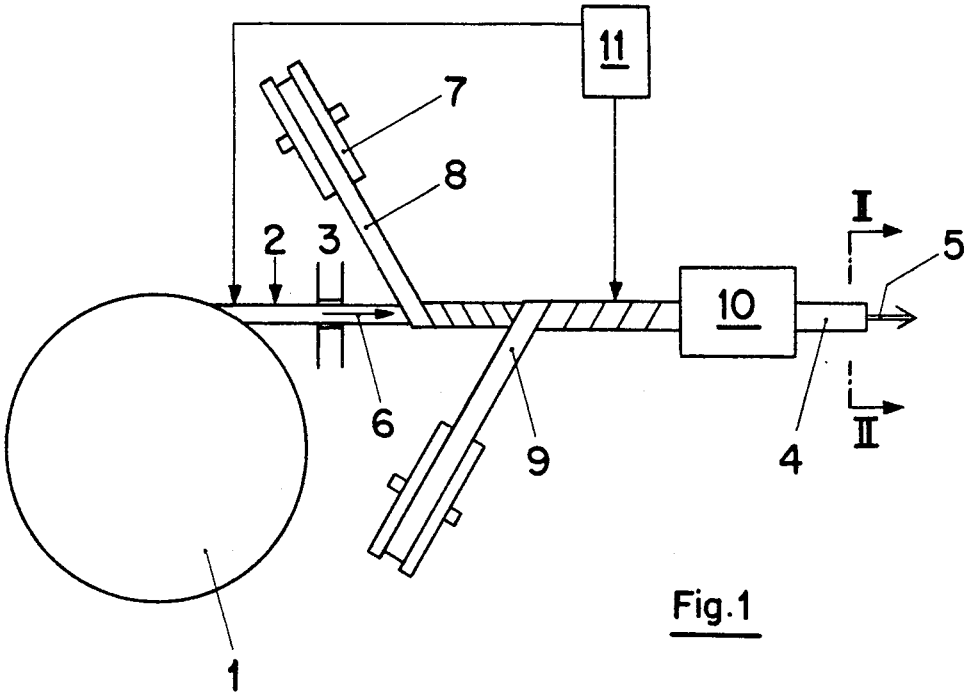
FIG. 1 shows an apparatus for producing a conductor according to the invention.

As may be seen from the drawing, the apparatus illustrated in FIG. 1 comprises a storage drum 1 for a hollow electrical conductor core 2 to be insulated, a tensioning device 3 for holding the latter under tension, and a transport arrangement 5 acting on the finished conductor 4. Conductor 2 is made from a super-conductive material. The transport arrangement 5 moves the conductor 2 in the tensioned state in the direction of the arrow 6, and between the tensioning device 3 and the transport arrangement 5 there is a tape-winding machine provided with a spool 7 of insulating tape which helically winds insulating tape 8, consisting of inorganic insulating material, onto the conductor 2 which is to be insulated in one or more layers of overlapping turns. The insulating tape 8 may consist at least partly, for example, of a metal oxide and/or glass fibre and/or asbestos and/or mica. As examples, the insulating tape can be entirely of glass fibres or asbestos, or the glass fibres or asbestos can be covered with mica. Also suitable are thin oxidized metal (aluminum) sheet, thin oxidized metal (aluminum) braid, woven tapes of mixed oxidized metal (aluminum) strips and glass or asbestos fibres, and glass fibre or asbestos tape filled with pulverized glass or oxidized metallic material.

The conductor 2 helically wound with insulating tape 8 is then helically wound with a metal tape 9, and in a further station 10 the edge portions of the overlapped turns of metal tape are soldered or welded to form a gas-tight sheath. The metal tape 9 used here is preferably made of copper or a copper alloy or aluminum, and is 0.05 to 0.5 mm thick. As previously mentioned, the relatively thin metal tape 9 can be made either from the solid metal itself, or from stranded material which is woven, or plaited, or otherwise fashioned into fabric form. Before the soldering or welding station 10 there is furthermore an insulation-testing arrangement 11 which measures the insulation between the insulated conductor 2 and the sheath consisting of the metal tape 9 while said conductor is being fed forward. Since the sheath is made of metal, it is very simple to measure the insulation.

Figure 2:
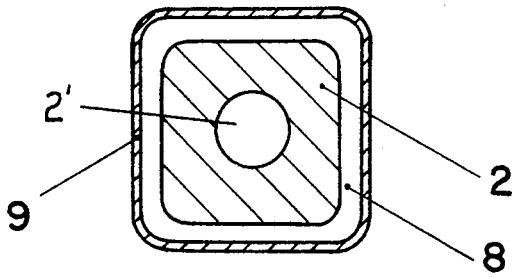
FIG. 2 shows a section along the line II in FIG. 1 for the purpose of illustrating the cross-section of an insulated conductor produced in accordance with the invention.

FIG. 2 illustrates a section along the line II—II of FIG. 1, from which the cross-section of the finished insulated conductor may be seen. It will be seen that the conductor 2 of superconductive material is provided with an internal cooling duct 2'.

Figure 4:
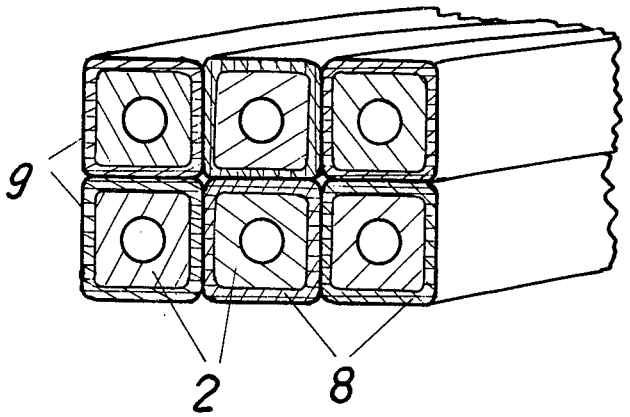
FIG. 4 is a perspective view of a portion of a helically wound coil made from the ducted superconductive material following application of the insulating layer and metallic sheath thereto.

The metal sheath of the finished insulated conductor confers the additional advantage that when the conductor is subsequently wound helically to make a coil, a portion of which is shown in FIG. 4, the adjacent turns of the helical coil can be soldered or welded to one another by means of the metal sheathing, and thus the joining materials are also resistant to radiation.

Figure 3:
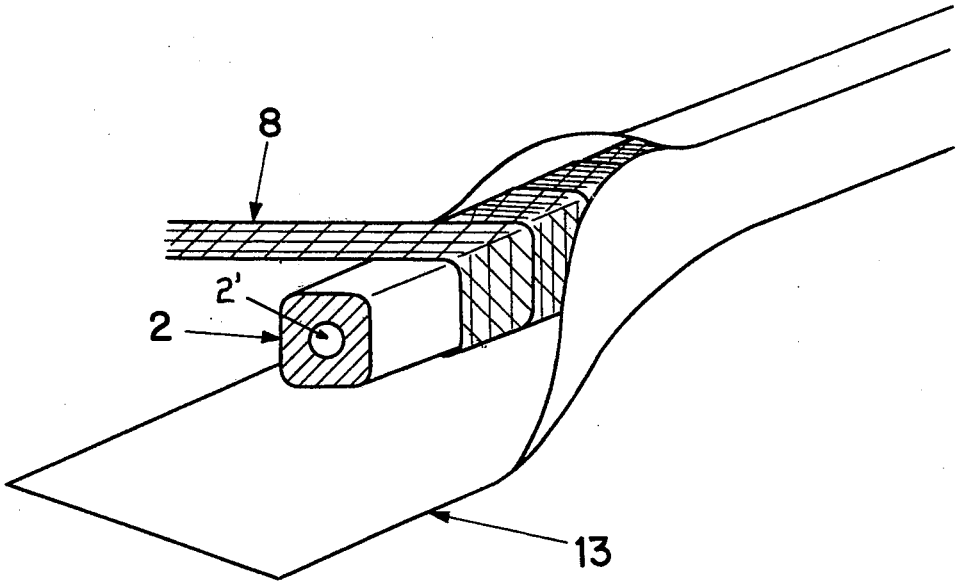
FIG. 3 shows in diagrammatic form a further process for the production of a conductor insulated in accordance with the invention.

FIG. 3 illustrates a further process for the production of an insulated conductor, wherein in contradistinction to the process illustrated in FIG. 1 a metal tape 13 made from solid metal or fashioned into fabric form is folded in its longitudinal direction around the conductor 2 wound with insulating tape 8, and then soldered or welded.

I claim:

1. An electrical superconductive coil formed by a helically wound insulated electrical conductor and which exhibits a high degree of resistance when exposed to strongly ionizing radiation, said electrical conductor being constituted by an electrically conductive core of superconductive material and which is provided with an internal longitudinally extending cooling duct, an insulating layer consisting of inorganic insulating material applied to said conductor core and an electrically conductive metallic gas-tight sheath completely covering the layer of inorganic insulating material, the metallic sheaths on adjacent turns of the coil being secured together.

2. An electrical coil as defined in claim 1 wherein said layer of inorganic insulating material on said conductor core is made from a material selected from the group consisting of a metal oxide, glass fibre, asbestos and mica.

* * * * *